US006736294B2

(12) United States Patent
Smith

(10) Patent No.: US 6,736,294 B2
(45) Date of Patent: May 18, 2004

(54) APPARATUS FOR DISPENSING RINSE WATER ADDITIVE IN AN AUTOMATIC WASHING MACHINE

(75) Inventor: Christopher Lawrence Smith, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/246,498

(22) Filed: Sep. 18, 2002

(65) Prior Publication Data

US 2003/0052138 A1 Mar. 20, 2003

Related U.S. Application Data

(60) Provisional application No. 60/322,967, filed on Sep. 18, 2001.

(51) Int. Cl.[7] ..... B67D 5/64
(52) U.S. Cl. ..... 222/463; 222/498; 222/500
(58) Field of Search ..... 222/463, 498, 222/500; 137/53, 56

(56) References Cited

U.S. PATENT DOCUMENTS

| | | | |
|---|---|---|---|
| 2,956,709 | A | 10/1960 | Nison et al. |
| 3,044,665 | A | 7/1962 | Ludwig et al. |
| 3,095,722 | A | 7/1963 | Fox |
| 3,108,722 | A | 10/1963 | Torongo, Jr. et al. |
| 3,180,538 | A | 4/1965 | Brown et al. |
| 3,215,311 | A | 11/1965 | Nison et al. |
| 3,661,299 | A | 5/1972 | Durstewitz |
| 3,888,391 | A | 6/1975 | Merz |
| T993,001 | I4 | 4/1980 | McCarthy |
| 4,656,844 | A | 4/1987 | Mulder et al. |
| 4,703,872 | A | 11/1987 | Cornette et al. |
| 4,835,804 | A | 6/1989 | Arnau-Munoz et al. |
| 4,875,600 | A | 10/1989 | D'Hoogue et al. |
| 4,893,726 | A | 1/1990 | Vesborg |
| 4,915,267 | A | 4/1990 | Buecheler et al. |
| 4,942,973 | A | 7/1990 | Bowie |
| 4,944,165 | A | 7/1990 | Leebeek et al. |
| 4,969,927 | A | 11/1990 | Schumann et al. |
| 4,982,467 | A | 1/1991 | Mizusawa et al. |
| 5,033,643 | A | 7/1991 | Schumacher |
| 5,129,120 | A | 7/1992 | Cornette et al. |
| 5,267,671 | A | 12/1993 | Baginski et al. |
| 5,314,098 | A | 5/1994 | Milenkevich |
| 5,355,541 | A | 10/1994 | Rutter et al. |
| 5,358,152 | A | 10/1994 | Banks |
| 5,388,298 | A | 2/1995 | Rutter et al. |
| 5,768,918 | A | 6/1998 | McKibben |
| 5,978,994 | A | 11/1999 | Anderson |

*Primary Examiner*—Gene Mancene
*Assistant Examiner*—Melvin A Cartagena
(74) *Attorney, Agent, or Firm*—Jason J. Camp; Mark A. Charles; Brahm J. Corstanje

(57) ABSTRACT

A rinse water additive dispenser having an upper housing having a opening and a lower housing releasably connected to the upper housing, the lower housing walls defining an internal chamber for containing a rinse water laundry additive. The dispenser further comprises a valve assembly having a valve for sealing the opening in the upper housing, the valve movable between closed and open positions and being biased towards an open position. In addition, the dispenser includes a weight assembly having a counterweight that is actuated by centrifugal force, and which prior to actuation, prevents the valve from biasing to an open position.

14 Claims, 2 Drawing Sheets

APPARATUS FOR DISPENSING RINSE WATER ADDITIVE IN AN AUTOMATIC WASHING MACHINE

CROSS REFERENCE TO RELATED APPLICATIONS

This application claims priority under 35 U.S.C. §19(e) to U.S. Provisional Application Serial No. 60/322,967, filed Sep. 18, 2001.

TECHNICAL FIELD

The present invention relates to an improved method and apparatus for dispensing a rinse water additive in an automatic washing machine.

The present invention further relates to such a method and apparatus which is suited to both liquid and solid rinse water additives which are generally highly concentrated and added in relatively small volumes, thereby making accurate measurement and avoidance of leakage during the wash cycle critical to obtaining the desired benefits to be provided by the additive during the rinse cycle.

BACKGROUND OF THE INVENTION

Dosing dispensers for the addition of laundering and softening materials during the washing and rinsing cycles in an automatic washing machine are well known in the art.

Dispensers for adding materials during the rinse cycle in an automatic washer are generally more complex than those employed for adding materials during the wash cycle due to the fact that the rinse additive dispenser is normally inserted when the wash cycle begins and must survive the entire wash cycle without leakage or dispensing the material contained inside, yet reliably open during the spin cycle to deliver the rinse water additive at the point in time at which it will be more effective.

Rinse water additive dispensers commonly employ a valve that is automatically opened by the centrifugal forces acting upon a counterweight during the spin cycle at the conclusion of the wash operation. After the spin cycle, dispensers of the aforementioned type fall from the wall of the washing machine drum and rinse water floods the dispenser, mixing with and dispensing the additive into the rinse water. One prior art example of such a rinse additive dispenser is disclosed in U.S. Pat. No. 3,888,391 issued to Merz on Jun. 10, 1975 and hereby incorporated herein by reference. Another example of such a prior art rinse water additive dispenser is disclosed in U.S. Defensive Publication No. T993,001 to McCarthy, which was published on Apr. 1, 1980, and which is hereby incorporated herein by reference. Similar examples are found in U.S. Pat. No. 5,267,671, issued to Baginski et al. on Dec. 7, 1993 and U.S. Pat. No. 5,768,918 issued to McKibben on Jun. 23, 1998, both of which are incorporated herein by reference.

While dispensers of the aforementioned type have functioned adequately for their intended purpose with prior art rinse water additives, trends in the development of more effective rinse water additives have been in the direction of more specialized and/or highly concentrated additive products that can deliver a variety of performance benefits. Such additive products are not generally limited to free flowing liquids but can also include granules, agglomerates, more viscous pastes and gels, as well as solids and encapsulates. A disadvantage of the dispensing devices known in the art is that fact that the additives are delivered into the dispenser through the same opening that is sealed by the counterweight, an opening that is generally limited in size. Additional problems associated with these devices include the fact that the valve means is commonly not removable from this opening nor the counterweight from the internal chamber. In such a design, the presence of the valve means presents an obstacle that interferes with the introduction of flowable rinse additives into the dispenser leading to spillage and waste, as well as preventing the use of solid and encapsulated additives that can not pass through the partially obstructed opening.

An additional problem associated with the prior art dispensing devices is that it is commonly difficult to properly seat the valve means prior to the placement of the dispenser in the washing machine. When not properly seated, these valves tend to either dislodge prematurely during the wash cycle where rinse water additives give ineffective and unsatisfactory results or fail to open at all.

Accordingly, it is an object of the present invention to provide a dispensing apparatus having an improved valve seal design that simplifies the proper seating of the valve means and closure of the dispensing device. Protection against premature opening is extremely important for rinse additive dispensers, since premature opening of the dispenser during the wash cycle will most likely result in complete loss of the additive during the wash cycle.

It is another object of the present invention to provide a dispensing device having an improved design that will provide an unobstructed opening through which the dispenser may be filled with rinse water additives of various forms and sizes.

SUMMARY OF THE INVENTION

The present invention provides a rinse additive dispenser having an upper housing having a opening and a lower housing releasably connected to the upper housing, the housing walls defining an internal chamber for containing a rinse water laundry additive. The dispensers of the present invention further comprise a valve assembly having a valve for sealing the opening in the upper housing. The valve is movable between closed and open positions and is biased towards an open position. In addition, the dispensers of the present invention include a weight assembly having a counterweight that is actuated by centrifugal force and which prior to actuation prevents the valve from biasing to an open position.

In a further aspect of the present invention, the dispenser valve assembly has a valve retainer contained within the upper housing for retaining said valve, and biasing means for biasing the valve to an open position. Preferably, the means for biasing the valve to an open position is a coil spring. In addition, the valve is provided with a stem that extends through the valve retainer.

In yet a further aspect of the present invention, the dispenser weight assembly has a weight retainer contained within the lower housing for retaining the counterweight, and centering means to aid in centering the counterweight. In addition, the counterweight has a post that extends through the weight retainer and the centering means. Preferably, the centering means is a swivel joint. Alternatively, or in addition to, the centering means can include a resilient guide member affixed to the weight retainer around the post to bias the counterweight post to a centerline position.

In yet a further aspect of the present invention, the upper and lower housings of the dispensing device are releasably connected by threads, hinge, tongue and groove structures, magnets, or push-pull snap closures on the upper and lower housings respectively.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
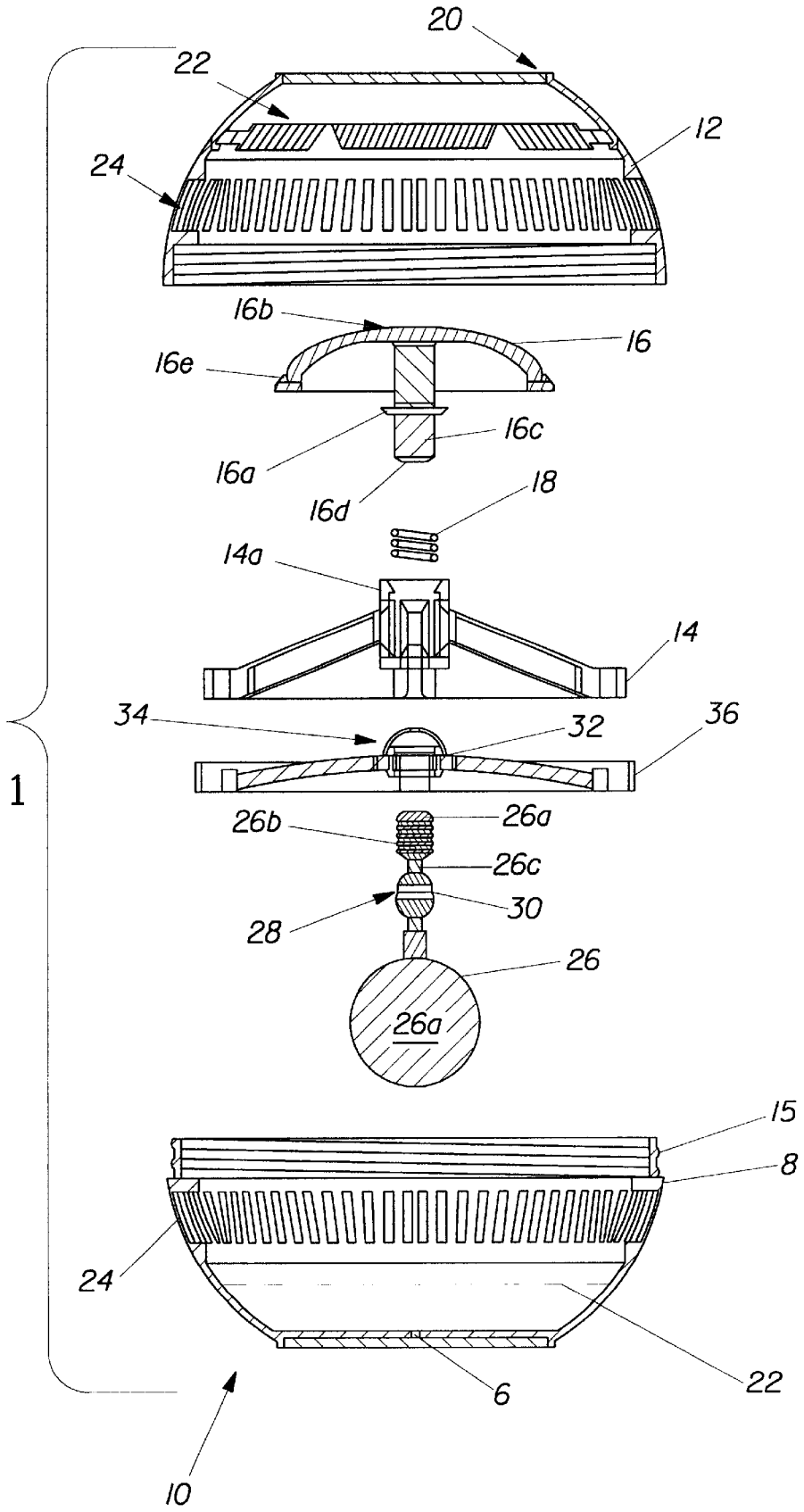
FIG. 1 is an exploded view a dispensing device of the present invention illustrating various elements of the dispensing device.

Referring now to the Figures, and more particularly to FIG. 1, the rinse additive dispensing device 10 includes upper housing 12 releasably connected to lower housing 8 by threads 15.

Upper and Lower Housings

Although assembled device 10 is spherical in shape as shown in the Figures, and will be described as such hereinafter, the dispensing devices of the present invention and the release mechanism provided by the valve and weight assemblies described below are not particularly dependent on shape or size of the dispensing device. However, the size of the device should be sufficient to accommodate the form and volume of the rinse additive to be delivered by the device. For flowable additives, the size and shape of the device are not critical. However, where the additive is a relatively large solid or encapsulated article, the device, and in particular the lower housing, should be sufficiently large that the solid additive is easily inserted into the dispenser and does not interfere with the actuation of the counterweight during the spin cycle. For solid articles it is preferred that the device have a long axis that is at least about 2.5 and less than about 7.5 inches.

As noted, the upper and lower housings are releasably connected so that prior to use, the housings may be separated to facilitate the introduction of rinse additives. Preferably, the housings will be releasably connected by mating structures on the respective housings such as threads, tongue and groove structures, magnets, or push-pull snap closures. In addition, it is envisioned that the housings may be connected by hinge structures to facilitate alignment during closure. Whatever means are used to releasably secure the upper and lower housings of the device, it is preferred that the device include means to prevent the two housings from being compressed together too tightly. For example, where the upper and lower housings are releasably connected by threads, it is preferred that the device have means to prevent to over-rotation of such threads. Where threads are used to releasably connect the two housings, it is preferred that the pitch of the threads will enable the device to be closed or opened in one half of a turn.

Upper housing 12 has an enlarged opening 20 for allowing fluid communication between the internal chamber of the dispensing device and the rinse bath solution. Upper housing 12 will preferably have ridges 24 about the outer surface of the housing to aid in gripping the housing, such as when the upper and lower housings need to be rotated relative to one another to secure them to one another. Threads 15 are shown on both upper and lower housings as means for releasably connecting to the upper to the lower housing. Optionally, but preferably, upper housing 12 will have information 22 printed or formed into the outer surface of the upper housing. Such information may include a trademark or reference to the manufacturer, but will preferably include instructions for operating dispensing device 10.

Lower housing 8 is illustrated with threads 15 for releasably connecting the lower to the upper housing. Like upper housing, lower housing has ridges 24 to aid with gripping the lower housing and information 22 printed, embossed or formed into the outer surface of the lower housing. As illustrated in FIG. 1, information 22 on lower housing 8 is preferably demarcation to indicate one or more specific internal volumes levels or "fill-lines".

Lower housing 8 is also provided with inlet 6 located at the base of the lower housing. Inlet 6 is a "one-way" valve inlet that will only allow water to enter the internal chamber of the dispensing device and will not allow materials within the chamber to exit. During the wash cycle, water enters the internals chamber through inlet 6 and mixes with the additive(s). Where the additives are more viscous or solid additives, the entry of water during the wash initiates their dissolution, further insuring that the presence of the additives will not interfere with the actuation of the valve. As explained in more detail below, the valve is actuated to open during the spin cycle and allow the additives to flow from the dispensing device through opening 20.

The sidewalls of the upper and lower housings can be made of a thermoplastic material such as polypropylene by stretch blow molding, injection molding and other molding processes that are well known in the art. More specifically, the sidewalls will be made of any polymeric materials that will provide sufficient strength to the dispensing device that it will withstand repeated wash/rinse cycles in an automatic washing machine. In addition, it is preferred that the material of the sidewalls be translucent or even transparent to enable the user to view the additive that is being introduced into the device and to accurately measure the additive for dispensing. Where desired, it is envisioned that only a portion of the sidewalls may have such light transmission properties.

It is also preferred that the sidewalls of the upper and lower housings have a protective material (not shown in the Figures) over at least a portion of the outer surface of the sidewalls. The purpose of this protective material is to protect the dispensing device, the washing machine components and the fabrics in the washing machine from any damage that might otherwise occur during the agitation and spin cycles. Preferably, such a protective material is a thermoplastic material that may be molded and subsequently affixed to the outer surface of the sidewalls. As noted, protective material may be applied to the whole of the outer surfaces of the top and base portions of the device or applied to only portions of these surfaces to enhance the aesthetics of the dispensing device.

Valve Assembly

The dispensing device of the present invention has a valve assembly, preferably affixed to and contained within upper housing 12. As shown in FIG. 1, this valve assembly includes valve 16, spring 18 and valve retainer 14.

As illustrated, valve 16 is a mushroom-shaped structure having stem 16*c*, cap 16*b*, shoulder 16*a* and terminal end 16*d*. The peripheral edge 16*e* of cap 16*b* has a recessed portion for receiving and engaging with the periphery of opening 20. The dispensing device is in the closed position when valve cap 16*b* is held against and edge 16*e* seals with the peripheral edges of opening 20 of upper housing 12. To provide a more secure seal between valve 16 and opening 20 and to prevent leakage prior to the rinse cycle, it is preferred that at least edge 16*e* be made of a elastomeric material. Elastomers such as Shore A 58 durometer polyisoprene elastomer formed by injection molding processes of the type well known in the art may be used to form edge 16*e* or a lining for this portion of cap 16*b*. Alternatively, natural rubber and other types of elastomers can be compression molded to form edge 16*e*.

The material selected for cap 16*b* and the other elements of valve 16 should be sufficiently strong and/or rigid to inhibit deformation of the structure under use conditions. Therefore, the use of elastomeric material(s) may be limited to the peripheral edge 16*e* while the rest of cap 16*b*, stem 16*c* and shoulder 16*a*, need not have elastomeric properties. As such, these other elements of valve 16 may comprise materials such as metals, e.g., aluminum, or substantially rigid plastics, e.g., molded polypropylene. By way of example, stem 16*c* may be molded using an acetal resin such as Delrin via an injection molding process of the type well known in the art.

Biasing means, shown as coil spring 18, preferably resides within valve retainer 14. Valve retainer 14 has an annular opening for receiving valve stem 16*c* and spring 18. Valve retainer 14 is further provided with annular flange 14*a*, which preferably has a one way snap geometry to facilitate assembly of the valve assembly. During assembly, spring 18 is installed about stem 16*c* between shoulder 16*a* and cap 16*b*. The valve stem and spring are then inserted into the annular opening in valve retainer 14 so that spring 18 bears against flange 14*a* and against valve shoulder 16*a* to provide a force that biases valve 16 away from opening 20.

Valve retainer 14 may be made from the same materials that are used to manufacture the upper and lower housings, but is preferably manufactured separately for subsequent assembly.

Weight Assembly

The weight assembly preferably resides within lower housing 8 and includes counterweight 26 and weight retainer 36. The counterweight is held in place by weight retainer 36, but under the influence of the centrifugal forces exerted during the spin cycle of an automated washing machine the counterweight is able to rotate or dislodge from a center position while being held by the weight retainer.

As illustrated in FIG. 1, the counterweight includes enlarged weight 26*a*, post 26*c* and terminal end 26*d* opposite the enlarged weight. Weight 26*a* is preferably molded in an open condition and thereafter closed about the post 26*c*. Weight 26*a* may be molded into a simple spherical shape but will preferably have a shape that mimics the shape of the overall dispenser. Weight 26*a* weighs between about 0.4 and about 0.6 ounces and is positioned so that the centrifugal acceleration typically experienced in a washing machine spin cycle will cause the counterweight to dislodge from the weight retainer or rotate from a center-line position. Of course, the weight and location of counterweight 26 may be altered as needed to insure that the centrifugal forces generated in the spin cycle are sufficient to dislodge the counterweight or cause it to rotate. In addition, counterweight 26 preferably has an enlarged portion 26*b* proximate terminal end 26*d* to aid in gripping the counterweight post and adjusting its orientation. Optionally, but preferably, ridges are provided on enlarged portion 26*c* to further enhance gripping of post 26*c*.

Weight retainer 36 is preferably affixed to and retained within lower housing 8. Weight retainer 36 has an annular opening through which post 26*c* extends. Like the valve retainer described above, the weight retainer is preferably made from the same materials that are used to manufacture the upper and lower housings, but again is preferably manufactured separately for subsequent assembly.

Preferably, the weight assembly includes centering means that allow the counterweight to rotate under the influence of the centrifugal forces generated during the spin cycle, but prevent the free rotation of the counterweight when such forces are not present. As illustrated in the Figures, such means can include swivel joint 32 on weight retainer 36 and swivel geometry 28 formed on post 26*c*. To prevent the free rotation of the counterweight at swivel joint 32 and to hold the counterweight on-center prior to the actuation of the device during the spin cycle, a self-locking mechanism is provided within the swivel joint. Groove 30 and a tongue element within the swivel joint (not shown) cooperate to provide this self locking mechanism between counterweight 26 and weight retainer 36. When the counterweight is oriented so that the tongue element is received within groove 30, the counterweight is held on-center with valve stem 16*c* until a minimum amount of force is exerted to cause it to dislodge and swing off center.

Alternatively, or in addition, the centering means can include resilient guide member 34 that is either formed during the manufacture of the weight retainer or manufactured separately and assembled subsequently. Guide member 34 is configured around the annular opening on weight retainer 36 opposite weight 26*a*. Guide member 34 acts as a spring to self-right the counterweight on-center with valve stem 16*c*, regardless of the orientation of the device when the upper and lower housings are connected. Guide member 34 is a flexible elastomer or rubber material that is preferably injection molded. Preferably, guide member 34 is manufactured from a terephthalate polyethylene elastomer.

In an alternative embodiment, it is envisioned that counterweight post 26*c* will have a pair of resilient radially extending flanges that will be narrowly spaced apart to receive weight retainer 36 therebetween. When the weight retainer is held between the flanges, they frictionally engage with the upper and lower surfaces of the weight retainer 36 respectively. This frictional engagement is sufficient to hold the counterweight fixed and centered with valve stem 16*c* until the centrifugal forces of the spin cycle are sufficient to dislodge the counterweight from the annular opening of the weight retainer. In such an embodiment, the counterweight may be repositioned and re-seated merely by pulling up on the enlarged portion 26*b* until the weight retainer is again sandwiched between the pair of flanges on post 26*c*.

Seating and Actuation of the Weight and Valve Assemblies

Prior to use, the upper and lower housings are disconnected and separated to facilitate the filling of the dispenser with a rinse water additive. As noted, the additives that may be used in the dispensers of the present invention include liquids, granules and other flowable materials, solids and encapsulates, and gels, pastes and other more viscous materials. The ability to separate the two housings of the device is a significant advantage because it provides an enlarged opening for introducing additives into the dispenser.

Prior to connecting the two housings, valve stem 16*c* and terminal end 16*d* will extend through and protrude from the annular opening of valve retainer 14 as spring 18 biases valve 16 into this open position. If not centered, counterweight 26 should be centered by hand so that it is centered with valve 16. Centering the counterweight will depend on the centering means that is present in the device, but will typically only required that the counterweight be pulled up into a locked position or adjusted to a "centered" position. As used herein, the terms "centered", "center-line" and similar terms refer to the orientation of counterweight post 26*c* relative to the long axis of valve stem 16*c*. Specifically, it is preferred that the counterweight post be parallel to he valve stem so that as the two housings are closed together, the ends of the post and stem abut against one another causing the valve to move into the closed position with the upper housing opening. As the upper and lower housings are secured to one another, the resilient edges of the valve move into sealing engagement with the peripheral edges of the opening in the upper housing.

Figure 2:
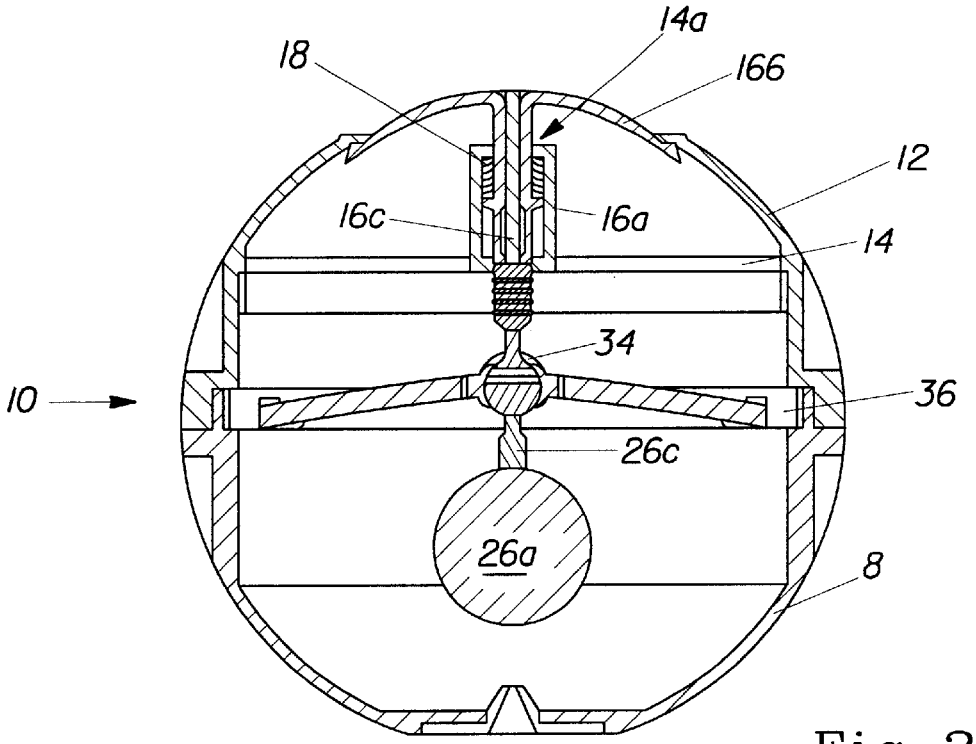
FIG. 2 is a cut away view of the assembled dispensing device illustrating the valve in the closed position.
Figure 3:
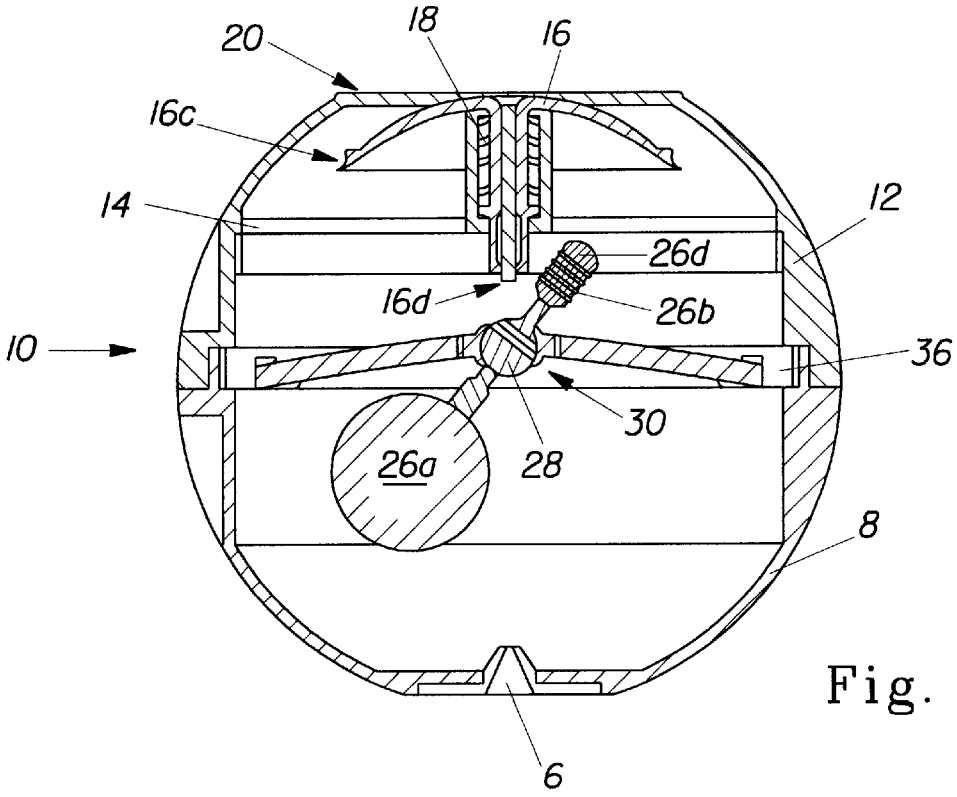
FIG. 3 is a cut away view of the assembled dispensing device illustrating the valve in an open position.

More specifically, and as shown in the FIGS. 2 and 3, opening 20 is concentric with the circumference of spherical device 10 such that valve stem 16*c* is substantially perpendicular to the plane of opening 20. When counterweight post 26*c* is parallel and centered with stem 16*c*, as the two housings are brought together, terminal ends 26*d* and 16*d* abut against one another causing valve 16 to slide upward towards opening 20. As the housings are secured together, valve edge 16*e* and the peripheral edge of opening 20 move into a sealing engagement. As previously noted, a variety of structures may be used to releasably secure the upper and lower housings together.

It is important that regardless of the orientation of the device, the centering means will prevent the counterweight from rotating off center from the valve stem prior to its actuation during the spin cycle. During the spin cycle, the centrifugal forces acting on counterweight 26 cause it to rock and dislodge/rotate off center, enabling valve 16 to be biased away from opening 20 by spring 18. Once counterweight 26 has been actuated by the centrifugal forces of the spin cycle and valve 16 is biased to an open position, the unseated valve allows for fluid communication between the internal chamber of device 10 and the rinse bath solution. Water is then able to enter the internal chamber containing the rinse water additive, mix with the additive and to dispense the additive during the rinse cycle. At the completion of the laundry cycle, the dispensing device may be removed and the two housings separated for its next use.

While particular embodiments of the present invention have been illustrated and described, it will be obvious to those skilled in the art that various changes and modifications can be made without departing from the spirit and scope of the invention, and it is intended to cover in the appended claims all such modifications that are within the scope of this invention.

What is claimed is:

1. A rinse water laundry additive dispenser comprising an upper housing having a opening;

a lower housing releasably connected to the upper housing, said lower housing having walls that define an internal chamber for containing a rinse water laundry additive;

a valve assembly having a valve for sealing the opening in the upper housing, said valve movable between a closed position and an open position and biased to an open position; and a weight assembly having a counterweight that is actuated by centrifugal force, prior to actuation said counterweight prevents the valve from biasing to an open position.

2. The dispenser of claim 1, wherein the upper and lower housings are threadedly connected.

3. The dispenser of claim 1, wherein the upper and lower housings are hingedly connected.

4. The dispenser of claim 1, wherein the valve assembly has a valve retainer contained within the upper housing for retaining said valve, and biasing means for biasing the valve to an open position.

5. The dispenser of claim 4, wherein the biasing means is a spring.

6. The dispenser of claim 4, wherein the valve has a stem that extends through the valve retainer, said stem having a terminal end for contacting said counterweight.

7. The dispenser of claim 1, wherein the weight assembly has a weight retainer contained within the lower housing for retaining said counterweight, and centering means to aid in centering the counterweight.

8. The dispenser of claim 7, wherein the counterweight has a post that extends through the weight retainer, the post having a terminal end for abutting against the valve.

9. The dispenser of claim 8, wherein the centering means comprises a swivel joint.

10. The dispenser of claim 9, wherein swivel joint has locking means to prevent free rotation of the counterweight.

11. The dispenser of claim 10, wherein the locking means is a tongue and groove in formed in the swivel joint.

12. The dispenser of claim 8, wherein the centering means comprises a resilient guide member on the weight retainer around the post.

13. The dispenser of claim 9, wherein a portion of the counterweight post has means for gripping the post.

14. The dispenser of claim 8, wherein the centering means is a pair of flanges extending radially from the post, said flanges spaced apart so as to receive and provide frictional engagement with the weight retainer therebetween.

* * * * *